United States Patent [19]

Yoshiura

[11] Patent Number: 4,615,610

[45] Date of Patent: Oct. 7, 1986

[54] COPYING APPARATUS HAVING ONE SET-TWO COPY MODE

[75] Inventor: Shoichiro Yoshiura, Yamatokoriyama, Japan

[73] Assignee: Sharp Kabushiki Kaisha, Osaka, Japan

[21] Appl. No.: 733,799

[22] Filed: May 14, 1985

[30] Foreign Application Priority Data

May 14, 1984 [JP] Japan ..... 59-98135
May 14, 1984 [JP] Japan ..... 59-98140

[51] Int. Cl.[4] ..... G03G 15/00

[52] U.S. Cl. ..... 355/14 R; 355/14 C; 355/46; 355/14 SH; 355/8

[58] Field of Search ..... 355/3 R, 14 R, 14 SH, 355/46, 47, 48, 49, 54, 8, 50, 14 D; 353/122, 65, 66, 67

[56] References Cited

U.S. PATENT DOCUMENTS

| | | | |
|---|---|---|---|
| 4,088,401 | 5/1978 | Rees et al. | 355/46 X |
| 4,113,370 | 9/1978 | Durbin | 355/46 X |
| 4,214,834 | 7/1980 | Findeis et al. | 355/46 |
| 4,352,553 | 10/1982 | Hirahara | 355/14 R X |
| 4,368,975 | 1/1983 | Matsui et al. | 355/8 X |
| 4,372,674 | 2/1983 | Yukawa et al. | 355/14 D |
| 4,387,979 | 6/1983 | Ohishi et al. | 355/3 R |
| 4,472,046 | 9/1984 | Kohyama | 355/3 R X |

*Primary Examiner*—A. C. Prescott

*Attorney, Agent, or Firm*—Birch, Stewart, Kolasch & Birch

[57] ABSTRACT

An improved copying apparatus having a one set-two copy mode, which is so arranged that by monitoring the original document set state during the one set-two copy mode setting period, the one set-two copy mode may be automatically released when the original documents are not properly set for an efficient copying operation without any erroneous functioning.

3 Claims, 10 Drawing Figures

COPYING APPARATUS HAVING ONE SET-TWO COPY MODE

BACKGROUND OF THE INVENTION

The present invention generally relates to a copying apparatus having one set-two copy function capable of separately copying two kinds of original documents placed on an original document platform and more particularly, to a copying apparatus capable of effecting one set-two copy mode operation, and provided with a function to prevent malfunctions in the case of improper setting of the original documents.

Referring to flow-charts in FIGS. 1(A) and 1(B), one example of functioning for copying procedures in a conventional copying apparatus having the one set-two copy mode will be described hereinbelow.

The known copying apparatus has a contracting function for 0.7, 0.8 and 0.9 times, and an enlarging function for 1.22 times. Upon depression of a contracting designation key for designating any one of the contractions for 0.7, 0.8 and 0.9 times, or an enlarging designation key for designating the enlargement for 1.22 times (steps n1 to n4), a READY lamp is first de-energized and after displacing a lens assembly to positions for respective magnifications (steps n5 to n7, n9 to n11, n13 to n15, n17 to n19), the READY lamp is energized (steps n8, n12, n16, n20). In the case where the designation for the contraction or enlargement is not effected, an equal size or life size copy mode is established.

For effecting the ordinary one set-one copy mode, after completion of the above magnification designation, the required number of copies to be made is input, and a print switch is depressed (steps n21 to n23), whereby the copying cycle is started to be terminated after completion of the copying for the required number of copies (steps n24, n25). Meanwhile, for effecting the one set-two copy mode, after input of the required number of copies to be made, the one set-two copy button is depressed to set the one set-two copy mode, with a subsequent depression of the print switch (steps n22 and n26). In the above one set-two copy mode, it is so arranged, for example, as shown in FIG. 2(A) or 2(B), that with respect to two sheets of A4 size original documents a1 and a2 or two sheets of B5 size original documents b1 and b2 placed on the original document platform T, images are transferred onto copy paper sheets according to the respective original documents. In the above case, copying of the required number of copies is first made with respect to the original document placed at the left side in FIG. 2(A) or 2(B), and then, copying for the original document placed at the right side thereof is effected (steps n27 to n30).

As described above, in the conventional copying apparatus having the one set-two copy function, the arrangement is so made that, upon setting to the one set-two copy mode, this mode is executed without regard to the state of setting of the original documents. Therefore, if an operator is unaware of the set mode, with the mode being set as it is to the one set-two copy mode, and starts copying with the intention of effecting the one set-one copy mode by setting one original document at the left side (reference setting position) of the original document platform, there has been such an inconvenience that the original document setting area at the right side where no original document is placed at that time, is undesirably subjected to exposure after the exposure of the original document setting area at the left side, thus resulting in a wrong copying function.

SUMMARY OF THE INVENTION

Accordingly, an essential object of the present invention is to provide an improved copying apparatus having the one set-two copy mode, which is so arranged that by monitoring the original document set state during the one set-two copy mode setting period, the one set-two copy mode may be automatically released when the original documents are not properly set, with substantial elimination of disadvantages inherent in the conventional copying apparatuses of this kind.

Another important object of the present invention is to provide a copying apparatus of the above described type, which is capable of preventing the wrong function as described earlier, through detection of whether or not the set state of the original documents is correct so as to start the copying function only when such set state is proper.

A further object of the present invention is to provide a copying apparatus of the above described type, which is simple in construction and reliable in function, and can be readily manufactured at low cost.

In accomplishing these and other objects, according to one preferred embodiment of the present invention, there is provided a copying apparatus with a one set-two copy mode for copying original documents placed on respective two original document setting areas of an original document platform, according to each of the original documents, in addition to ordinary one set-one copy mode. The copying apparatus includes a sensor means for detecting the original documents placed on the original document platform, an original document set state judging means for judging whether or not the original documents are set on both of the original document setting areas based on an output of the detecting sensor means during setting of the one set-two copy mode, and an ordinary mode restoring means for restoring the ordinary one set-one copy mode by releasing the one set-two copy mode upon determination that the original documents are not set on both of the original document setting areas by the original document set state judging means.

By the above construction of the present invention, since it is so arranged that, during setting of the one set-two copy mode, when the original documents are not set on both of the original document setting areas of the original document platform, the one set-two copy mode is automatically released, with simultaneous restoration to the one set-one copy mode, there is no possibility of such an erroneous copying operation that the area in which no original document is set is undesirably exposed even when the original document is set only on the original document setting area at one side, with the one set-two copy mode being set as it is, and thus, the copying can be executed by the one set-one copy mode only with respect to the set original document, thereby improving reliability of the copying apparatus.

Moreover, in another aspect of the present invention, the copying apparatus having a malfunction preventing function includes a sensor means for detecting set state of original documents, a key means for setting one set-two copy mode, a one set-plurality copy mode display portion for displaying by flickering light and the like, that the original documents are improperly set when the original documents are not in a properly set state through detection by the sensor means upon setting of the one set-two copy mode, and means which accepts copying start signal when the original documents are in the properly set state, and which does not accept the copying start signal when the original documents are not in the properly set state upon setting of the one set-two copy mode.

By the above arrangement of the present invention, it becomes possible to notify an operator whether or not the original documents are in a properly set state during setting to the one set-two copy mode, and also to execute the copying function only during the properly set state of the original documents.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figures 1A, 1B:
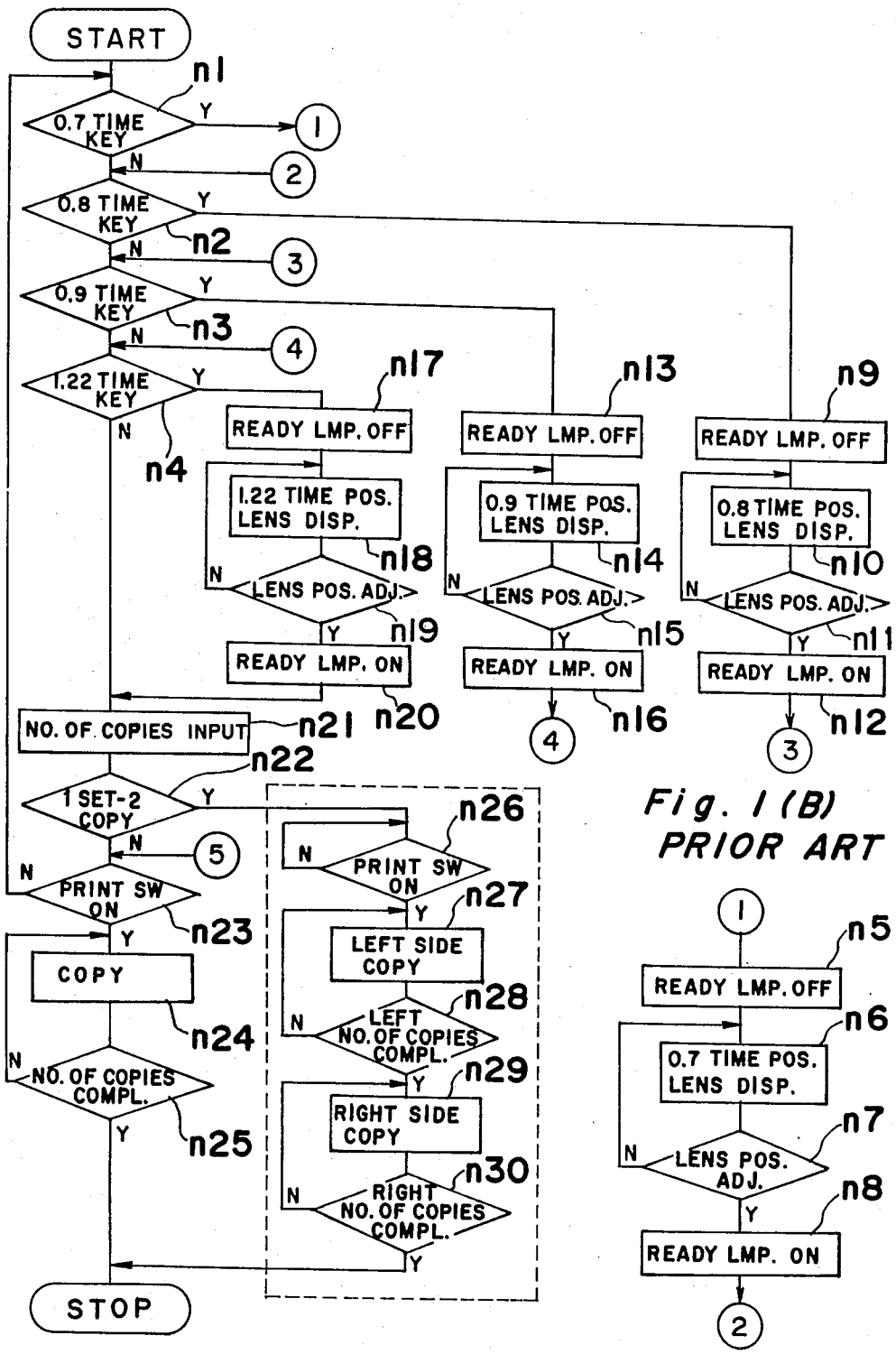
Fig. 1(A) PRIOR ART
Fig. 1(B) PRIOR ART
FIGS. 1(A) and 1(B) are flow-charts for explaining copying procedures in a conventional copying apparatus having one set-two copy mode (already referred to)
Figure 2A:
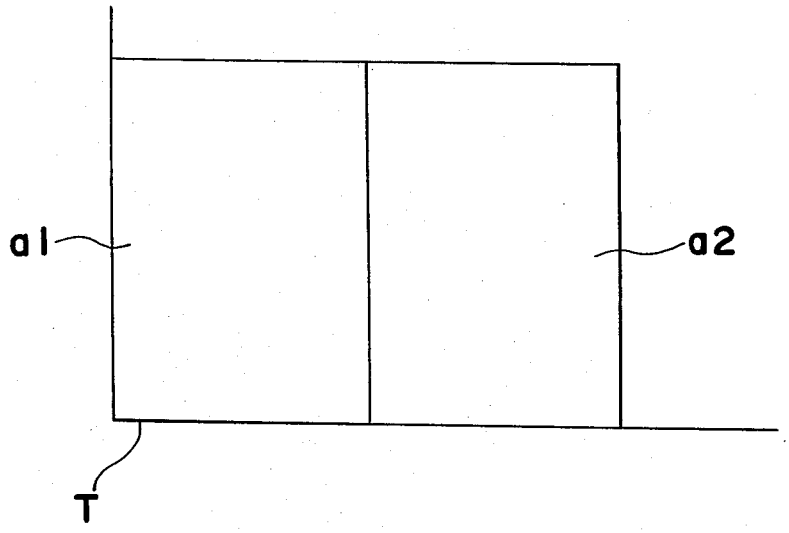
FIGS. 2(A) and 2(B) are each diagrams showing states where two original documents of different sizes are placed on an original document platform (already referred to)
Figure 2B:
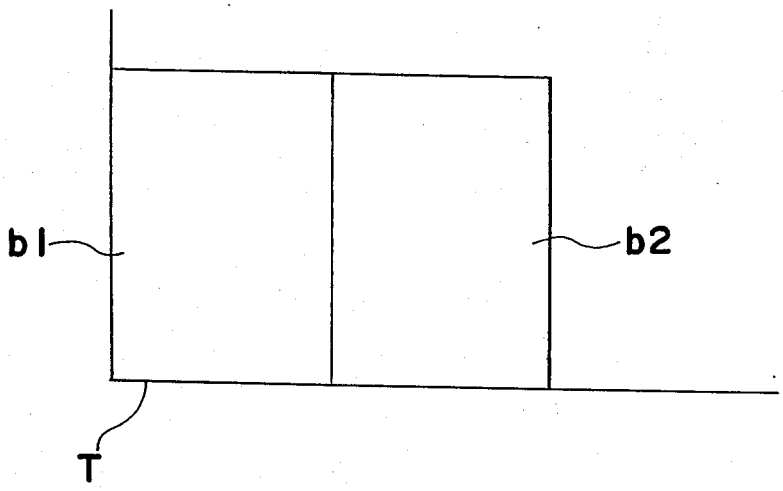

Before the description of the present invention proceeds, it is to be noted that like parts are designated by like reference numerals throughout the accompanying drawings.

Figure 3:
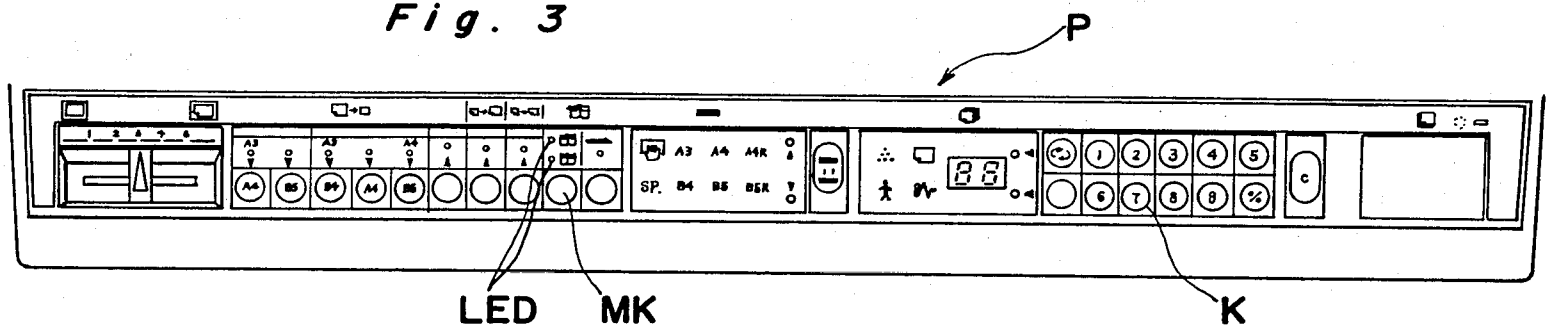
FIG. 3 is a front elevational view of a control panel employed in a copying apparatus according to one preferred embodiment of the present invention.
Figure 4:
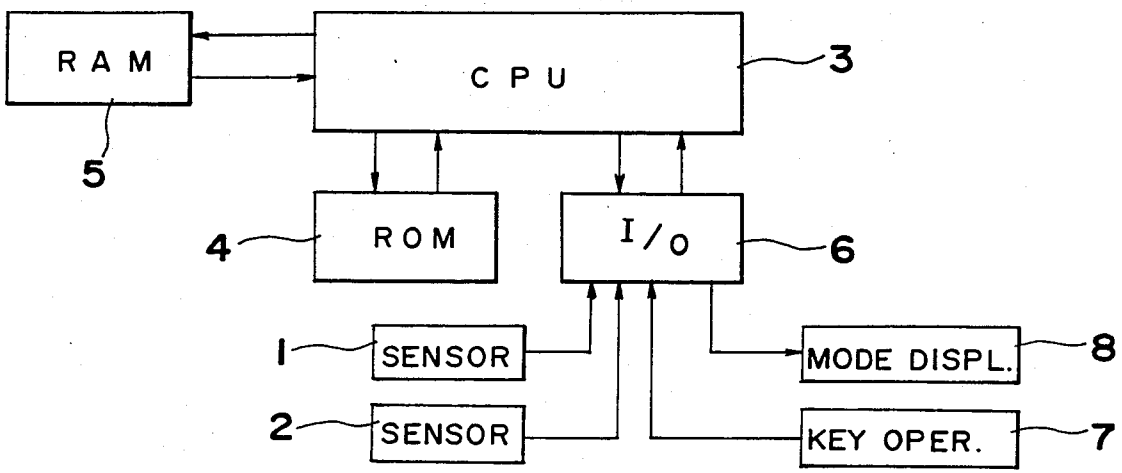
FIG. 4 is a block diagram of a control section for the copying apparatus according to one preferred embodiment of the present invention.

Referring now to the drawings, FIG. 3 illustrates a control panel P of a copying apparatus (not particularly shown) according to one preferred embodiment of the present invention having, for example, ten-keys K for setting the number of copies to be taken, a one set-two copy mode key MK, and copy mode display LED (light emitting diodes), etc., while in FIG. 4, there is shown a control section for said coying apparatus, which includes a CPU 3 (central processing unit) coupled to an RAM 5 (random access memory), an ROM 4 (read only memory), and an I/O (input/output) interface 6, which is applied with signals from original document sensors 1 and 2 and a key operating section 7, and outputs a signal to a mode display section 8 including the copy mode display LED, etc. on the control panel P referred to above.

The copying apparatus according to the embodiment of the present invention has the one set-two copy mode function and copying function at variable magnifications in the similar manner as in the conventional copying apparatus whose functions are described earlier with reference to FIGS. 1(A) and 1(B), but is different from the known copying apparatus in that it effects, during the one set-two copy mode, a processing different from that surrounded by a dotted line in FIG. 1(A) (i.e., steps n26 to n30).

In the copying apparatus constituted by a microcomputer system including the CPU 3, ROM 4 and RAM 5, etc., the sensors 1 and 2 are adapted to detect whether or not original documents are set on the original document platform T, and the outputs thereof are applied to the CPU 3 through the I/O interface 6. The key operating section 7 is arranged to effect the key inputs by designation keys for the one set-one copy mode and one set-two copy mode such as the key MK referred to earlier, ten-keys K for the input of the number of copies to be taken, magnification designation keys, etc., and the key input data applied to the CPU 3 through the I/O interface 6.

Figure 5:
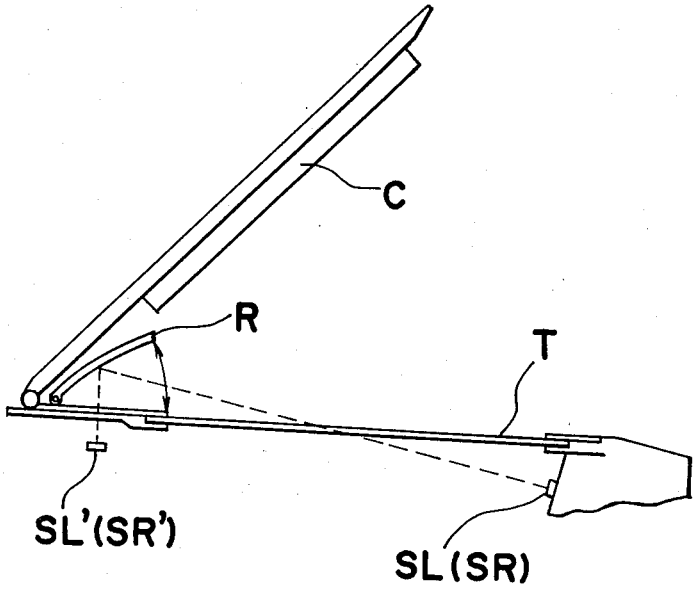
FIG. 5 is a schematic side elevational view in the vicinity of an original document platform for the copying apparatus of the present invention, showing positions of sensors employed therein.
Figure 6:
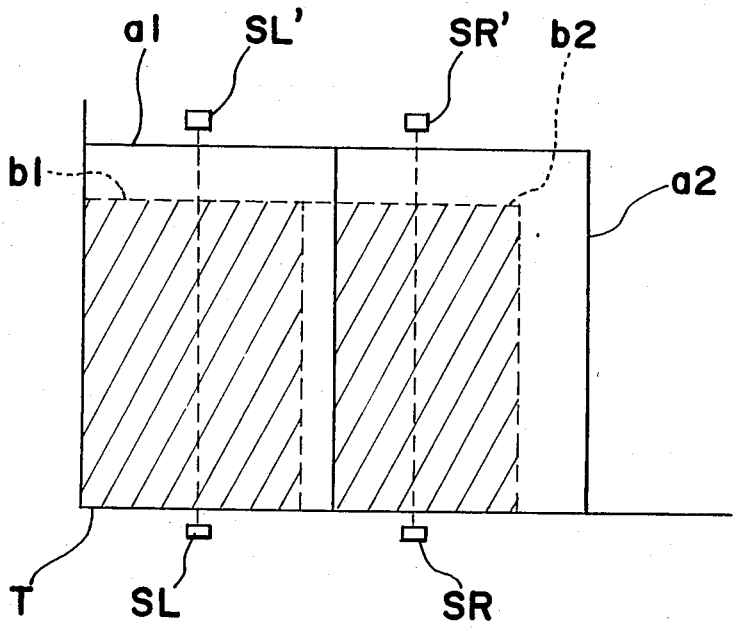
FIG. 6 is a diagram showing original document setting areas on the original document platform in FIG. 5.

Reference is further made to FIG. 5 showing disposition of the sensors 1 and 2 in the vicinity of the original document platform T, and also to FIG. 6 illustrating original document setting areas on the original document platform T.

As shown in FIG. 6, the original document setting areas on the original document platform T have a size sufficient to place thereon two original documents a1 and a2 of A4 size, or two original documents b1 and b of B5 size side by side as illustrated, with the setting area at the left side in FIG. 6 being set as the reference setting position. Hatched portions in FIG. 6 represent overlapping areas when the original documents of A4 and B5 sizes are placed on the original document platform T. Meanwhile, the sensor 1 includes a set of light emitting sensor SL′ and light receiving sensor SL, and the sensor 2 also includes another set of light emitting sensor SR′ and light receiving sensor SR. The light emitting sensors SL′ and SR′ provided, for example, at the left side in FIG. 5 below the platform T adjacent to a hinged portion of an original document cover C, are arranged to emit infrared rays towards a reflecting plate R adapted to be moved in association with the pivotal upward or downward movements of the cover C for opening or closing. The infrared rays from the light emitting sensor SL′ reflected by the reflecting plate R are transmitted through an approximately central portion of the original document setting area denoted by the hatched portion at the left side in FIG. 6, and received by the light receiving sensor SL. Similarly, the infrared rays from the light emitting sensor SR′ reflected by the reflecting plate R are transmitted through an approximately central portion of the original document setting area denoted by the hatched portion at the right side in FIG. 6, and received by the light receiving sensor SR. By the disposition of the sensors SL and SL′ and SR and SR′ as described above, it becomes possible to detect the original documents set on the respective two original document setting areas, according to the setting areas. More specifically, in the case where two original documents of A4 size or B5 size are set on the respective original document setting areas in the one set-two copy mode, infrared rays are intercepted by the set original documents so as not to be received by the light receiving sensors SL and SR, and therefore, both the sensors 1 and 2 are turned off, thus making it possible to detect that the two original documents are set on the setting areas in the normal manner. Such detection of the original documents is effected when the original document cover C is to be closed. After having set the original documents on the platform T, as the original document cover C is gradually closed or turned downwards, the cover C depresses the reflecting plate R so as to be inclined at a predetermined angle, and at this time, infrared rays emitted from the light emitting sensors SL' and SR' are reflected by the reflecting plate R and projected onto the corresponding light receiving sensors SL and SR. The respective sensor outputs during the above original document setting are stored in a sensor output memory area of the RAM 5.

Table 1 below gives a comparative list of original document set states which may be judged by the combination of the sensor outputs of the sensors 1 and 2 according to the light receiving amounts by the light receiving sensors SL and SR during the one set-two copy mode.

TABLE 1

| Sensor 1 | Sensor 2 | Original Document Set State |
|---|---|---|
| L | L | O |
| L | H | X |
| H | L | X |
| H | H | X |

In the above Table 1, the symbol H (i.e., "on" state) represents that the light receiving sensor has received infrared rays and detected the state where no original documents are set, while the symbol L (i.e., "off" state) denotes that the light receiving sensor does not receive infrared rays, and has detected the state where the original documents are set. During the one set-two copy mode, when both of the sensors 1 and 2 are "L", it is judged as the state where the original documents are set on both of the original document setting areas, and represented by marks O in the column for the original document set states. In cases where the combinations of the sensor outputs are other that the above, it is regarded that the original document is set only at one side or original documents are not set on both of the setting areas so as to be judged as the state where the original document setting is improper, and denoted by marks X in the column.

Referring now to a flow-chart of FIG. 7, specific functionings for the one set-two copy mode according to the copying apparatus of the present invention will be described. It should be noted here that procedures for steps n40 through n47 in FIG. 7 correspond to the procedures (steps n26 to n30) as surrounded by the dotted line in FIG. 1(A) for the conventional arrangement.

Figure 7:
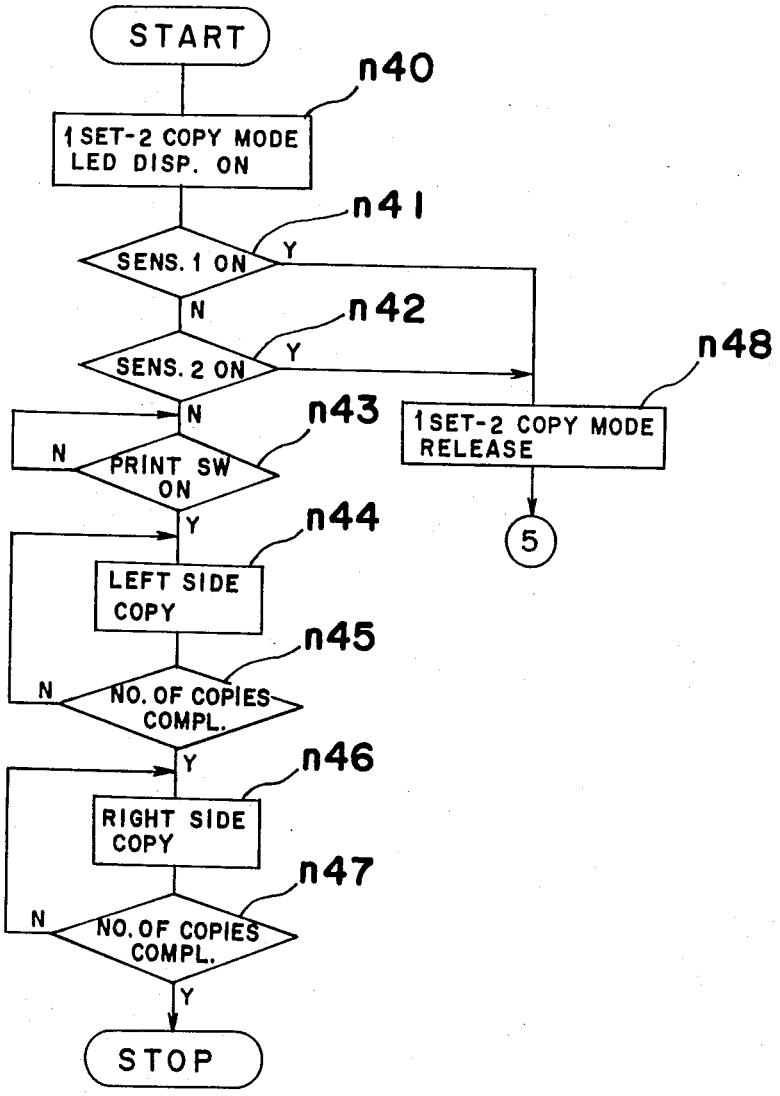
FIG. 7 is a flow-chart for explaining specific functions for the one set-two copy mode in the copying apparatus according to the one preferred embodiment of the present invention.

In FIG. 7, upon depression of the one set-two copy mode designation key (see step n22 in FIG. 1(A)), the one set-two copy mode display LED is lit at step n40. Subsequently, when the original document cover C is closed, the sensor outputs of the sensors 1 and 2 stored in the RAM 5 are read out, and the original document set state is judged based on Table 1 referred to earlier (steps n41 and n42). In the case where the sensor outputs of the sensors 1 and 2 are both "L", it is judged that the original documents are set on both of the original document setting areas, and the one set-two copy mode after step n43 is to be executed. This one set-two copy processing is started by the depression of the print switch (step n43), and after first effecting copying for the set number of copy paper sheets with respect to the original document at the left side setting area, copying is subsequently effected with respect to the right side setting area (steps n44 through n47). On the contrary, in the case where the sensor outputs of the sensors 1 and 2 are both "H" or only one of the sensor outputs is "L", it is judged that the original documents are not set on both of the original document setting areas or the original document is set only on one side of the setting areas. As a result of the above judgement, in the case of improper setting of the original documents in which the original documents are not set on both of the original document setting areas regardless of the fact that the one set-two copy mode has been set, the one set-two copy mode is released, and the execution of the mode processing is inhibited (step n48). After the above releasing, the procedures proceed from step n48 to step n23 (FIG. 1(A)) for automatic restoration to the one step-one copy mode. Accordingly, even if the operator is unaware that the one set-two copy mode has been set and starts copying, with the original document being set only on the left side setting area as the reference position, the one set-two copy mode is automatically released in this case through detection of the original document set state so as to effect the one set-one copy mode only with respect to the left side setting area, and thus, such an erroneous copying that the right side setting area without the original document is undesirably exposed, may be advantageously prevented.

It is to be noted here that, although the sensors 1 and 2, as described above, are intended to detect the original documents on the original document setting areas, it may be so modified that these sensors are simultaneously used as original document size detecting sensors.

It should also be noted that the judging procedures of the original document set state based on Table 1 referred to earlier at steps n41 and n42, correspond to the original document set state judging means of the present invention, while step n48 corresponds to the ordinary mode restoring means according to the present invention.

Figure 8:
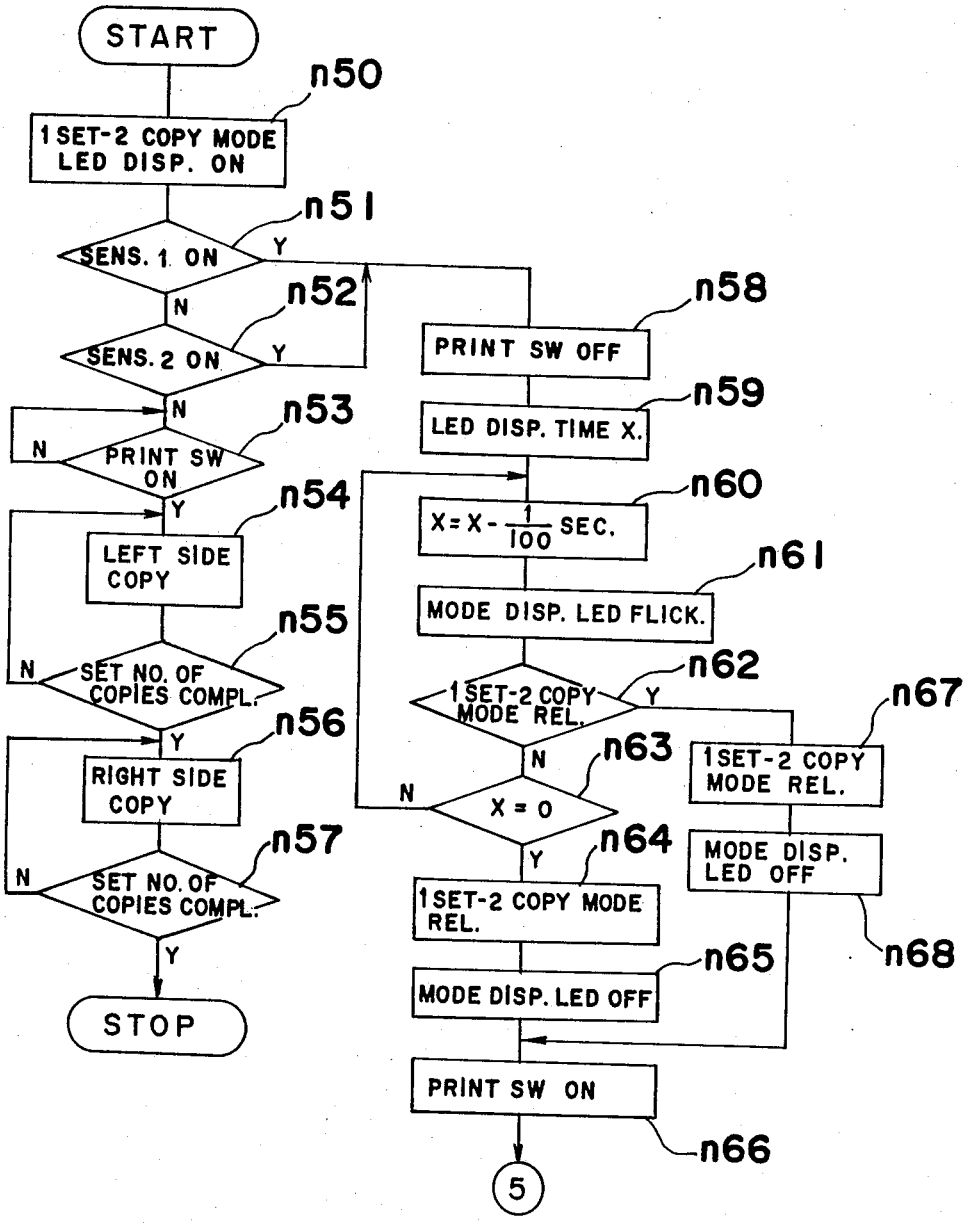
FIG. 8 is a flow-chart similar to that in FIG. 7, which particularly relates to a modification thereof.

Although the above embodiment described so far with reference to FIG. 7 relates to the case where, upon judgement that the original document setting is improper during the one set-two copy mode, the procedure is shifted to the automatic releasing of the one set-two copy mode without regard to the mode releasing operation by the operator, it may be so modified, for example, that the procedure proceeds to the mode releasing after giving a warning of such an improper state for a predetermined period of time, subsequent to the judgement that the original document setting is improper, as shown in a flow-chart of FIG. 8.

In FIG. 8, the procedures for steps n50 through n57 have the same contents as the procedures for steps n40 through n47 in FIG. 7. In the procedures in FIG. 8, when the original document setting is judged to be improper, the print switch is first turned off, and thereafter, a timer (not shown) for monitoring the flickering time of the one set-two copy mode display LED is preset to a predetermined time-up time X (steps n58 and n59). Upon starting of this timer, the one set-two copy mode display LED is flickered at intervals of, for example, 1/100 sec (steps n60 and n61). By causing the one set-two copy mode display LED to flicker until the preset time X is exceeded as described above, a warning for the improper original document setting is given to the operator. By the above warning, the operator can be clearly informed of the improper setting of the original documents during the one set-two copy mode setting at a glance for selection of the alteration to the one set-one copy mode or continuation of the one set-two copy mode, with a consequent improvement of the operability of the copying apparatus. During the warning, when the operator wishes to release the one set-two copy mode, this may be simply effected through operation of a mode clear key (not particularly shown) (step n62). In this case, before the preset time X is exceeded, the procedure is shifted to releasing of the one set-two copy mode, and the mode display LED is turned off, while the print switch is turned on (steps n67, n68 and n66). In the case where such mode clear operation as described above is not effected before the preset time X is exceeded, the procedure is shifted to the automatic releasing of the one set-two copy mode upon exceeding of the preset time (steps n63 and n64). In this case also, the print switch is turned on after turning off the mode display LED (steps n65 and n66) in the similar manner. When the one set-two copy mode is released by the mode clear during the warning or upon completion of the warning (steps n64 or n67), the procedure reverts to the one set-one copy mode in the similar manner as in the previous embodiment after turning on of the print switch (step n66).

As is seen from the foregoing description, by the copying apparatus having the erroneous function preventing function according to the present invention, since it is detected by the sensors whether or not the original documents are properly set, so as to give the warning display if the setting is improper, and also so as not to shift into the starting of the copying function, the inconvenience as in the conventional arrangement, such as formation of erroneous copies by starting the copying in the improperly set state of the original documents, may be advantageously prevented.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A copying apparatus provided with one set-two copy mode for copying original documents placed on respective two original document setting areas of an original document platform, according to each of the original documents, in addition to ordinary one set-one copy mode, said copying apparatus comprising:

a sensor means for detecting the original documents placed on said original document platform;

an original document set state judging means for judging whether or not the original documents are set on both of said original document setting areas based on an output of said detecting sensor means during setting of the one set-two copy mode; and an ordinary mode restoring means for restoring the ordinary one set-one copy mode by releasing the one set-two copy mode upon determination that the original documents are not set on both of the original document setting areas by said original document set state judging means.

2. A copying apparatus as claimed in claim 1, wherein said ordinary mode storing means includes means for giving a warning for a predetermined period of time ranging from the judgement by said original document set state judging means that the original documents are not set on both of said original document setting means, to the releasing of the one set-two copy mode.

3. A copying apparatus having a malfunction preventing function, which comprises a sensor means for detecting set state of original documents, a key means for setting one set-two copy mode, a one set-plurality copy mode display portion for displaying by flickering light and the like, that the original documents are improperly set when said original documents are not in a properly set state through detection by said sensor means upon setting of the one set-two copy mode, and means which accept copying start signal when the original documents are in the proprerly set state, and which does not accept the copying start signal when the original documents are not in the properly set state upon setting of the one set-two copy mode.

* * * * *